United States Patent [19]

Takahashi et al.

[11] 4,345,943

[45] * Aug. 24, 1982

[54] ABRASION RESISTANT SINTERED ALLOY FOR INTERNAL COMBUSTION ENGINES

[75] Inventors: Kentaro Takahashi; Yoshikatsu Nakamura, both of Omiya; Masajiro Takeshita, Yono, all of Japan

[73] Assignee: Nippon Piston Ring Co., Ltd., Tokyo, Japan

[ * ] Notice: The portion of the term of this patent subsequent to Jan. 6, 1998, has been disclaimed.

[21] Appl. No.: 143,231

[22] Filed: Apr. 24, 1980

[30] Foreign Application Priority Data

Apr. 26, 1979 [JP] Japan ..... 54-50850

[51] Int. Cl.[3] ..... B22F 3/12

[52] U.S. Cl. ..... 75/238; 75/237; 75/236; 75/241

[58] Field of Search ..... 75/203, 204, 123 D, 75/123 J, 126 F, 126 K, 239, 230; 428/550

[56] References Cited

U.S. PATENT DOCUMENTS

| | | | |
|---|---|---|---|
| 1,707,364 | 4/1929 | Palmer | 75/126 K |
| 2,038,639 | 4/1936 | Burgess | 75/126 K |
| 2,186,758 | 1/1940 | Krause | 75/126 K |
| 2,256,135 | 9/1941 | Cape | 75/123 D |
| 3,698,877 | 10/1972 | Motoyoshi | 75/211 |
| 3,767,386 | 10/1973 | Veda | 75/126 K |
| 3,890,105 | 6/1975 | Weissmann | 75/203 |
| 3,977,838 | 8/1976 | Hashimoto | 75/204 |
| 4,000,980 | 1/1977 | Morishita | 75/204 |
| 4,021,205 | 5/1977 | Matsuda | 75/126 F |
| 4,243,414 | 1/1981 | Takahashi | 75/222 |

FOREIGN PATENT DOCUMENTS 2508798 4/1975 Fed. Rep. of Germany .

*Primary Examiner*—L. Dewayne Rutledge
*Assistant Examiner*—J. J. Zimmerman
*Attorney, Agent, or Firm*—Sughrue, Mion, Zinn, Macpeak & Seas

[57] ABSTRACT

An abrasion resistant sintered alloy for use in internal combustion engines which comprises 0.5 to 4.0% by weight of C, 5.0 to 3.0% by weight of Cr, less than 10.0% by weight of at least one of Ni, Mo, Co and Cu, 0.1 to 5.0% by weight of at least one of P, B and Si which permits liquid-phase sintering at temperatures not higher than 1,250° C. and the balance iron, and have hardness after sintering of Hv 500 to 1,200, 7 to 45% by area ratio of cementite or eutectic crystal of cementite and P and 0.2 to 10% by volume of sintering pores at least 40% of which consist of pores having a pore size of not larger than 150 μm.

8 Claims, No Drawings

ABRASION RESISTANT SINTERED ALLOY FOR INTERNAL COMBUSTION ENGINES

BACKGROUND OF THE INVENTION

1. Field of the Invention

The present invention relates to an abrasion resistant sintered alloy for internal combustion engines, more specifically to sintered alloy for use in a slidable member for rocker arms, valve seats, piston rings, cylinder liners and the like.

2. Discussion of the Prior Art

Sintered alloy compositions exhibiting good abrasion resistance when in use as a slidable member at high planar pressures have been described in U.S. Patent Application Ser. No. 955,445 corresponding to German Patent Application (OLS) No. 2,846,122. This type of sintered alloy compositions are also described in U.S. Pat. Nos. 3,674,472, 2,637,671 and 3,698,877. Sintered alloy compositions which have further improved substrate structure and are superior particularly in pitting properties as compared with the conventional sintered alloy have been desired.

SUMMARY OF THE INVENTION

A primary object of the present invention is to provide an abrasion resistant sintered alloy composition (hereafter referred to as "sintered alloy composition") for internal combustion engines which exhibits excellent abrasion resistance when in use as a slidable member such as a rocker arm or the liner thereof used under severe conditions or as a member subjected to pitting wear such as a valve seat, etc.

As a result of extensive research made with reference to the test results, information, etc. of the sintered alloy compositions previously developed is achieved the present invention which provides a sintered alloy composition for internal combustion engines characterized by an alloy composition comprising 0.5 to 4.0% by weight of carbon, 5.0 to 30.0% by weight of chromium, not more than 10% by weight of at least one of nickel, molybdenum, cobalt and copper and 0.1 to 5.0% by weight of at least one of phosphorus, boron and silicon which permits sintering at temperatures not higher than 1,250° C., and the balance iron, having a hardness Hv (Vickers hardness) of 500 to 1,200, having 7 to 45% by area ratio of cementite or an eutectic crystal of cementite and phosphorus, and having 0.2 to 10% by volume of sintering pores at least 40% of which consists of pores having a pore size of not more than 150 μm.

DETAILED DESCRIPTION OF THE INVENTION

Description of Preferred Embodiments

In a preferred embodiment the abrasion resistant alloy of the present invention comprises 0.5 to 4.0% by weight of C, 5.0 to 30.0% by weight of Cr, 0.1 to 4.0% of Mo, 0.1 to 10.0% of Ni and 0.1 to 5.0% of P which permits liquid phase sintering at temperatures not higher than 1,250° C. and the balance iron, having a hardness Hv after sintering of 500 to 1,200, having 7 to 45% by area ratio of cementite or an eutectic crystal of cementite and P, having 0.2 to 10% by volume of sintering pores at least 40% of which consists of pores having a pore size of not more than 150 μm.

In a more preferred embodiment the abrasion resistant alloy of the present invention comprises 0.5 to 4.0% by weight of C, 5.0 to 20.0% by weight of Cr, 0.4 to 3.0% by weight of Mo, 0.1 to 5.0% by weight of Ni and 0.2 to 3.0% by weight of P which permits liquid phase sintering at temperatures not higher than 1,250° C., having a hardness Hv after sintering of 500 to 1,200, having 7 to 45% by area ratio of cementite or an eutectic crystal of cementite and P, and having 0.2 to 10% by volume of sintering pores at least 40% of which consists of pores having a pore size of not more than 150 μm.

The activity of the various individual components of the sintered alloy composition of the present invention and the reasons for limiting their amounts are explained below.

Carbon is necessary for strengthening the substrate structure and forming a precipitation of cementite or eutectic crystal of cementite and phosphorus (hereafter referred to "cementite phase") to impart abrasion resistance to the sintered alloy composition. The reason for the limiting the amount of carbon as an alloy component is as follows. If the amount of carbon is less than 0.5% by weight, the amount of the cementite phase is inadequate, and abrasion resistance sufficient for the abrasion resistant members of internal combustion engines is not obtained. Furthermore, a high strength substrate is not obtained. On the other hand, if the amount of the cementite phase exceeds 4.0% by weight, the degree of brittleness of the material increases to such an extent that it is no more useful. Therefore, the amount of carbon in the sintered alloy composition of the present invention need be set within the range of 0.5 to 4.0% by weight.

Generally, sintered alloy composition for internal combustion engines are required to have satisfactory abrasion resistance when subjected to pitting or repeated loads or used under sliding conditions. It is known, however, that slidable members made of sintered alloy obtained by usual solid-phase sintering have many pores and therefore have a low strength. Hence, such slidable members tend to undergo pitting wear under repeated loads.

It is found that abrasion resistance can advantageously be increased by subjecting the composition to liquid-phase sintering.

Conventionally, liquid-phase sintering is performed at high temperatures. However, in view of the durability of the sintering furnace, it is necessary to perform liquid-phase sintering at temperatures not higher than 1,250° C. For this purpose at least one of P, B and Si is added to the composition. Phosphorus is useful for forming precipitation of eutectic crystal of cementite and P to thereby improve abrasion resistance. P, B and Si are effective because they are elements which permit liquid-phase sintering at low temperatures, i.e., not higher than 1,250° C., and the temperature at which liquid-phase appear is decreased in inverse proportion to the increase in the amount of the elements.

When the amount of at least one of P, B and Si is less than 0.1% by weight the amount of liquid phase is too small and increase in abrasion resistance is not obtained. On the other hand, when the amount of at least one of P, B and Si is greater than 5.0% by weight, the amount of liquid-phase becomes too large and a sintered body having a high dimensional accuracy cannot be obtained. For this reason at least one of P, B and Si is used in an amount of 0.1 to 5.0% by weight. Of the above three elements P is most preferred since P is most effective for forming a liquid-phase and does not lower the strength of the substrate structure. The amount of P added is 0.1 to 5.0% by weight, preferably 0.2 to 3.0% by weight. The amount of Si is preferably not greater than 1.5% by weight since Si increases degree of brittleness of the substrate when added thereto in amounts greater than 1.5% by weight.

In case where the alloy composition obtained by liquid-phase sintering under conditions described above contains silicon, cementite precipitates in the substrate and in case where the alloy contains P, eutectic crystals of cementite and P precipitate in the substrate. This cementite phase (cementite and/or eutectic crystal of cementite and P) is very important for providing the substrate structure with abrasion resistance. When the amount of the cementite phase is less than 7% by area ratio satisfactory abrasion resistance cannot be obtained. On the other than, it is practically difficult to produce alloy compositions containing cementite phase in amounts greater than 45% by area ratio. Therefore, the amount of the cementite phase is limited to 7 to 45% by area ratio.

Further, the hardness of the sintered alloy composition obtained by liquid-phase sintering should have a Vickers Hardness (Hv) of 500 to 1,200. This is because abrasion resistance of the alloy composition is not satisfactory for use in internal combustion engines when the hardness is below Hv 500, while at Hv of greater than 1,200 abrasion of a counterpart member by the member made of the alloy composition becomes so serious to that these members cannot be used as a pair.

Regarding the porosity, if the porosity exceeds 10% by volume, sintering is insufficient and the bond strength amongst the particles is weak. Thus, the resulting alloy is susceptible to fatigue and tends to induce pitting wear. Furthermore, its mechanical strength is degraded. Accordingly, porosity is limited to not more than 10% by volume. If it is less than 0.2% by volume, there are too few oil pools, and the product has poor retension and is susceptible to scuff wear. The importance of pores is evident from the fact that non-porous material obtained from a solution of the same components cannot give expected properties.

Desirably, the pores are fine and are dispersed uniformly. When the pore size is more than 150 μm and the porosity is less than 10% by volume, the pores are not uniformly present and the oil retension of the product is very poor. Accordingly, for the same reason, scuff wear tends to occur if fine pores having a size of not more than 150 μm are present in an amount of less than 40%.

For the foregoing reason, the sintered alloy composition of the present invention should comprise 0.5 to 4.0% by weight of carbon, 0.1 to 5.0% by weight of at least one of phosphorus, boron and silicon which permits liquid-phase sintering at temperatures not higher than 1,250° C., and the balance iron and have a hardness after sintering of Hv 500 to 1,200, 7 to 45% by area ratio of cementite or eutectic crystal of cementite and phosphorus and 0.2 to 10% by volume of sintering pores at least 40% of which consist of pores having a pore size of not larger than 150 μm.

After sintering, the product of the present invention is mainly perlite. The substrate structure can be strengthened in manners known in the art, if desired or necessary, depending upon the slidable members with which it is used. The substrate structure can be strengthened by heat-treatment of the composition after sintering to convert it mainly to a bainitic or martensitic structure. In this case, the pitting resistance of the product increases further. For example, when the product is heated at 870° C. after sintering and heat-treated in a salt bath at about 400° C. for about 10 to 40 hours, the substrate structure becomes bainitic. When it is heated at 870° C. and then heat-treated with water or oil at room temperature, the substrate structure becomes martensitic.

It is very advantageous for further strengthening the substrate structure to add at least one of Ni, Mo, Co and Cu in an amount of not more than 10% by weight. These elements alone or in combination can achieve sufficient strengthening when added in an amount of not more than 10% by weight and from the standpoint of economy, as well, the amount is advantageously limited to not more than 10% by weight.

Among Ni, Mo, Co and Cu, Mo is most preferred since it is most effective for strengthening the substrate structure. When Mo is added in an amount less than 0.1% no strengthening effect is obtained, but in an amount of more than 4.0% by weight the substrate structure becomes brittle. Therefore, the sintered alloy composition of the present invention should comprise 0.1 to 4.0% by weight. Most preferred amount of Mo is 0.2 to 3.0% by weight. Ni can be added in an amount of 0.1 to 10.0% by weight, preferably 0.2 to 3.0% by weight, which amount gives desired effect without rendering the substrate structure brittle. In order to further strengthen the substrate structure Co and/or Cu can be added preferably in an amount of 0.1 to 5.0% by weight as the total amount of Co and/or Cu, which amount is sufficient for obtaining desired effect but does not render the substrate structure brittle.

Further, the starting powders which are to be sintered contain Mn, the amount of which should be limited to not more than 1.0% by weight lest it should render the substrate structure brittle.

The addition of Cr is very effective for further improving the abrasion resistance of the sintered alloy composition of the present invention. That is, Cr containing carbide precipitates in the cementite phase when Cr is added and this influences on the improvement of abrasion resistance very advantageously. The amount of Cr is limited to 0.2 to 30.0% by weight since no improvement of abrasion resistance is noted in an amount of less than 0.2% by weight, whereas in an amount of more than 30% by weight not only remarkable improvement of abrasion resistance is unexpected instead of increased price of the material or member but also machineability of the material is reduced. Preferred amount of Cr is 0.2 to 20.0% by weight.

As described hereinbefore, the present invention provides a specific liquid-phase sintered alloy composition which contains 7 to 45% by area ratio of cementite phase in the substrate structure and exhibits excellent abrasion resistance.

While the invention has been described in detail and with reference to specific embodiments thereof, it will be apparent to one skilled in the art that various changes and modifications can be made therein without departing from the spirit and scope thereof.

What is claimed is:

1. An abrasion resistant sintered alloy for use in internal combustion engines which comprises 0.5 to 4.0% by weight of C, 5.0 to 30.0% by weight of Cr, less than 10.0% by weight of at least one of Ni, Mo, Co and Cu, 0.1 to 5.0% by weight of at least one of P, B and Si which permits a low temperature liquid-phase sintering at temperatures not higher than 1,250° C. and the balance iron, and have hardness after sintering of Hv 500 to 1,200, 7 to 45% by area ratio of cementite or eutectic crystal of cementite and P and 0.2 to 10% by volume of sintering pores at least 40% of which consist of pores having a pore size of not larger than 150 μm.

2. The abrasion resistant sintered alloy according to claim 1, wherein said alloy comprises 0.1 to 10.0% of Ni, 0.1 to 4.0% of Mo and 0.1 to 5.0% of P.

3. The abrasion resistant sintered alloy according to claim 1, wherein said alloy comprises 5.0 to 20.0% of Cr, 0.4 to 3.0% by weight of Mo, 0.1 to 5.0% by weight of Ni and 0.2 to 3.0% by weight of P.

4. The abrasion resistant sintered alloy according to claim 3, wherein said alloy comprises 0.1 to 5.0% by weight of Co and/or Cu, less than 1.5% of Si and less than 1.0% of Mn.

5. The alloy of claim 1, wherein said alloy is heated, after sintering, at a temperature of about 400° C. to 1250° C.

6. The alloy of claim 1, wherein the alloy is heated, after sintering, at a temperature of about 870° C.–1250° C.

7. The alloy of claim 1, wherein the alloy is heated, after sintering, at a temperature of about 870° C.

8. The alloy of claim 1, wherein the alloy is heated, after sintering, at a temperature of about 400° C.

* * * * *